US011920592B2

(12) United States Patent
Iltchev et al.

(10) Patent No.: US 11,920,592 B2
(45) Date of Patent: Mar. 5, 2024

(54) DRY PUMP FOR GAS AND SET OF A PLURALITY OF DRY PUMPS FOR GAS

(71) Applicant: ATELIERS BUSCH SA, Chevenez (CH)

(72) Inventors: Théodore Iltchev, Grandvillars (FR); Stéphane Varrin, Coeuve (CH); Didier Müller, Delémont (CH)

(73) Assignee: ATELIERS BUSCH SA, Chevenez (CH)

( * ) Notice: Subject to any disclaimer, the term of this patent is extended or adjusted under 35 U.S.C. 154(b) by 154 days.

(21) Appl. No.: 17/439,018

(22) PCT Filed: Mar. 14, 2019

(86) PCT No.: PCT/EP2019/056501
§ 371 (c)(1),
(2) Date: Sep. 14, 2021

(87) PCT Pub. No.: WO2020/182317
PCT Pub. Date: Sep. 17, 2020

(65) Prior Publication Data

US 2022/0145886 A1 May 12, 2022

(51) Int. Cl.

| | |
|---|---|
| ***F04C 23/00*** | (2006.01) |
| ***F04C 18/08*** | (2006.01) |
| ***F04C 18/12*** | (2006.01) |
| ***F04C 18/16*** | (2006.01) |
| ***F04C 25/02*** | (2006.01) |

(52) U.S. Cl.
CPC ..... *F04C 23/005* (2013.01); *F04C 18/084* (2013.01); *F04C 18/126* (2013.01);
(Continued)

(58) Field of Classification Search
CPC .... F04C 11/005; F04C 11/006; F04C 23/005; F04C 23/006; F04C 2/126; F04C 2/16;
(Continued)

(56) References Cited

U.S. PATENT DOCUMENTS 5,549,463 A * 8/1996 Ozawa ..... F04C 18/126 418/9
5,624,249 A * 4/1997 Rohlfing ..... F04C 13/00 418/102

(Continued)

FOREIGN PATENT DOCUMENTS

CN 112780563 A * 5/2021
KR 100591079 B1 * 6/2006

OTHER PUBLICATIONS

English translation of KR 100591079 B1 to Lim Moon Gi (Year: 2006).*

(Continued)

*Primary Examiner* — Laert Dounis
(74) *Attorney, Agent, or Firm* — Pearne & Gordon LLP

(57) ABSTRACT

A dry pump for gases comprises a first rotor (1) comprising a first lobe portion (1A) and a first screw (1B), as well as a second rotor (2) comprising a second lobe portion (2A) and a second screw (2B). A casing delimits an internal volume in which are located together the first and second screws (1B, 2B) and the first and second lobe portions (1A, 2A). Each of the first and second screws (1B, 2B) comprises a threading invariable along its length. The first and second rotors (1, 2) turn in opposite directions and are located in successive configurations. In a first configuration of the rotors, the first and second lobe portions (1A, 2A), a portion of the first screw (1B), a portion of the second screw (2B) and the casing together delimit a chamber (30) which is closed. In a second configuration of the rotors, the chamber (30) has a smaller capacity than in the first configuration. In a third configuration of the rotors, the chamber (30) is displaced entirely at the first and second screws (1B, 2B) and isolated from the lobe portions.

16 Claims, 5 Drawing Sheets

(52) U.S. Cl.
CPC ..... *F04C 18/16* (2013.01); *F04C 25/02* (2013.01); *F04C 2220/12* (2013.01); *F04C 2240/20* (2013.01); *F04C 2240/30* (2013.01); *F04C 2250/20* (2013.01)

(58) Field of Classification Search
CPC ..... F04C 2/165; F04C 18/126; F04C 18/16; F04C 18/165; F01C 11/006; F01C 11/008; F01C 1/126; F01C 1/16; F01C 1/165
See application file for complete search history.

(56) References Cited

U.S. PATENT DOCUMENTS 7,611,340 B2 11/2009 Wang et al.
8,556,607 B2 10/2013 Izawa et al.
2007/0048162 A1* 3/2007 Imai ..... F04C 18/084 418/206.1
2008/0025858 A1* 1/2008 Hwang ..... F04C 18/126 418/9
2011/0020162 A1* 1/2011 Izawa ..... F04C 14/02 418/201.3
2012/0230858 A1* 9/2012 Izawa ..... F04C 18/16 418/201.1

OTHER PUBLICATIONS

International Search Report issued in PCT/EP2019/056501 dated Dec. 10, 2019, 5 pages.
Written Opinion issued in PCT/EP2019/056501 dated Dec. 10, 2019, 5 pages.

* cited by examiner

FIG. 4
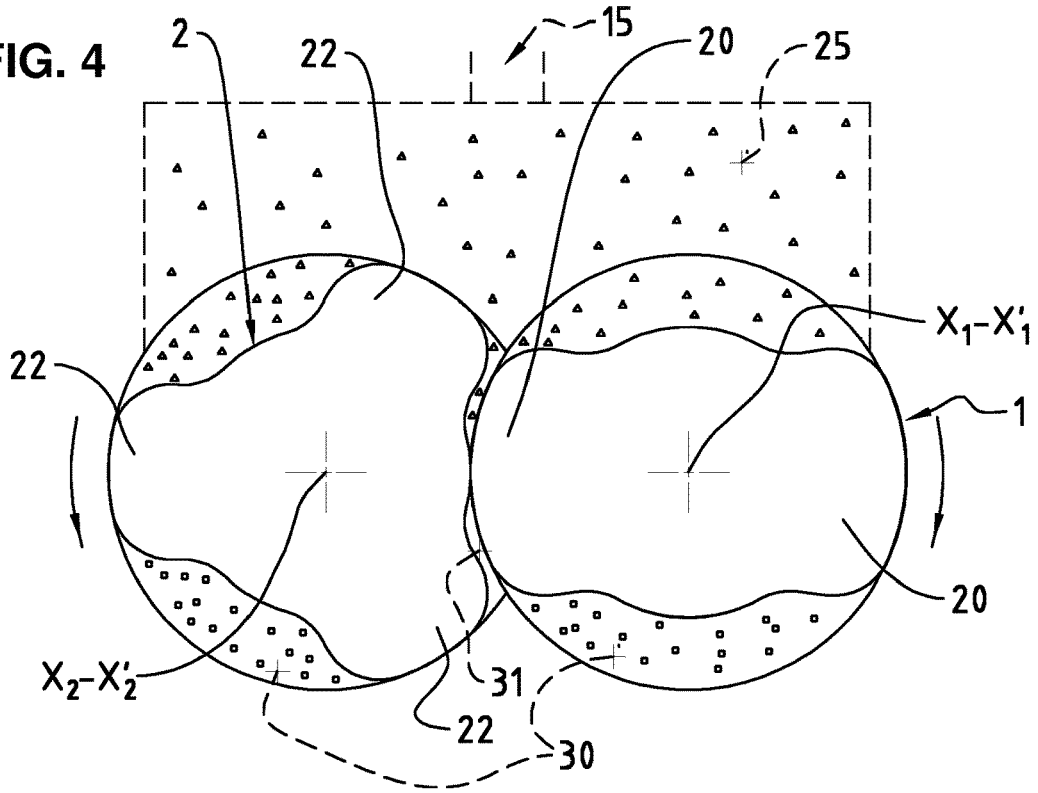
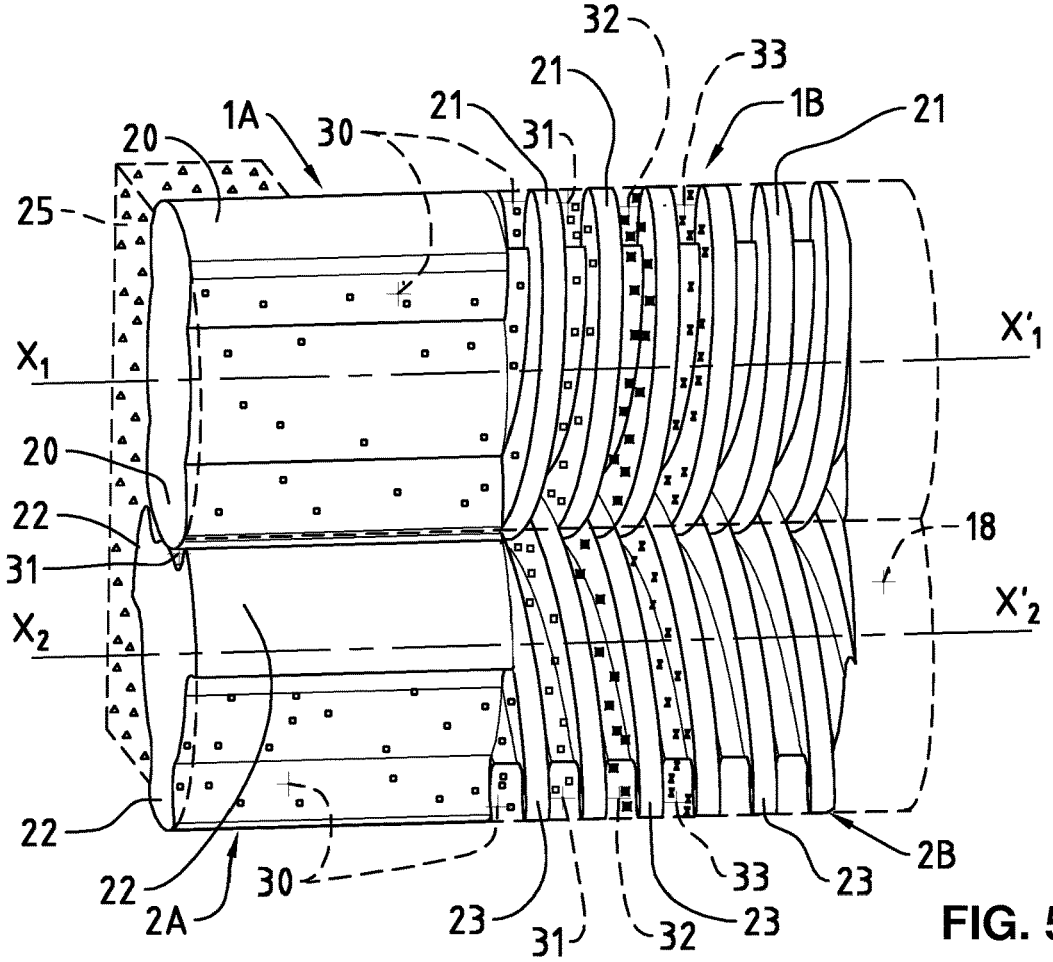
FIG. 5

DRY PUMP FOR GAS AND SET OF A PLURALITY OF DRY PUMPS FOR GAS

TECHNICAL FIELD OF THE INVENTION

The present invention relates to the field of pumping and the compression of gases. More specifically, it concerns a dry pump for gases as well as a set of a plurality of dry pumps for gases.

STATE OF THE ART

One type of dry pump for gases is the screw pump. A screw pump comprises two screws which mesh and which are driven in opposite directions, each on one of two parallel axes of rotation. In the case of certain mixed pumps, each screw belongs to a rotor, which further comprises a lobe portion, in such a way that the screw pump and a lobe pump are thus combined, as is the case, for example, in the American U.S. Pat. No. 7,611,340 B2.

In a screw pump, the threadings of the screws can vary along the screws, to define an internal compression rate of the gas between the upstream end of the screws and their downstream end. For example, the threadings of the screws can vary by means of a progressive or stepwise change of the pitch of each thread. Still in a screw pump, the number of turns of the threads along the screw can be changed, that is to say the length of the screws can be changed, in order to modify the dynamic "tightness" and thus the final pressure or the final vacuum obtained by the screw pump. In any case, a modification of the compression rate requires a new form of screw to be achieved, for each screw, while, in the screw pumps, the shape of the screws of variable threading is very complex and thus very difficult to design and to machine.

To modify the nominal flow rate of a screw pump, keeping the same speed of rotation and the same spacing, modified can be the pitch of the threads at the upstream end of the screws and/or the bottom diameters of the threads and consequently the crest diameters of the threads (the thread profile height). These modifications must remain within the limits of mechanical stability in rotation as well as within the possibilities of industrial machining. In any case, a change of the nominal flow requires a new form of screw to be achieved, for each screw, while, in the screw pumps, the shape of the screw of variable threading is very complex and thus very difficult to design and to machine.

SUMMARY OF INVENTION

The invention has at least as an object to simplify the design and/or the creation of a range of dry pumps for gases having different compression rates. More specifically, the invention has as an object to create a range of dry pumps for gases proposing, for the same or similar constraints with respect to bulkiness, energy consumption, etc., the flexibility and advantages of a variable pitch screw pump, but having rotors with a profile easier to design and/or to machine.

According to the invention, this object is achieved by means of a dry pump for gases comprising a first rotor comprising a first lobe portion and a first screw, a second rotor comprising a second lobe portion and a second screw, as well as a casing in which the first and second rotors are mounted for rotation in such a way that the first and second screws mesh and that the first and second lobe portions engage one with the other. The casing delimits an internal volume in which the first and the second screws and the first and the second lobe portions are located together. At least one inlet comes out into the internal volume at the first and second lobe portions. At least one outlet of the internal volume is located opposite the inlet in relation to the first and second screws. Each of the first and second screws comprises a threading invariable along its length. The first and second rotors are rotational in opposite directions in such a way as to be able to be located successively in:

- a first configuration in which the first and second lobe portions, a portion of the first screw, a portion of the second screw and the casing together delimit a chamber which is closed,
- a second configuration in which the chamber is always delimited by the first and second lobe portions, a portion of the first screw, a portion of the second screw and the casing in such a way as to be closed and have a smaller capacity than in the first configuration,
- a third configuration in which the chamber is displaced entirely at the first and second screws and isolated from the lobe portions at least by a helical thread of the threading of the first screw, a helical thread of the threading of the second screw and a blocking made by an intersection of the helical thread of the first screw and of the helical thread of the second screw, and
- a fourth configuration in which the chamber is displaced at the downstream end of the first and second screws and is in communication with the outlet.

The first and second screws have as a role to block and to open the chamber. The first and second lobe portions have as a role to carry out the compression. The first and second screws can thus not have as a role to carry out a compression, and the threading of each of them is invariable on its length. For this reason, these first and second screws are not difficult to design, nor to produce, compared with screws of variable threading.

Furthermore, the compression rate is a function of the first and second lobe portions. This compression rate can be modified by playing with the dimension of the first and second lobe portions in the axial direction. Starting with a given first screw and a given second screw, pumps not having the same compression rates can thus be constructed, depending on the axial dimension of the lobe portions that are associated with these first and second screws. Moreover, the lobe portions are much less difficult to produce than the screws.

Thus, a range of dry pumps for gases having different compression rates can be designed and produced more easily thanks to the invention.

The dry pump for gases defined above can incorporate one or more other advantageous features, alone or in combination, in particular from among those defined in the following.

Preferably, the first and second lobe portions comprise lobes each of which extends by one of the helical threads of the threadings of the first and second screws.

Preferably, the number of lobes of the first lobe portion is equal to the number of helical threads of the threading of the first screw, the number of lobes of the second lobe portion being equal to the number of helical threads of the threading of the second screw.

Preferably, the outlet is located at a distance from the first and second screws.

Preferably, the chamber is one of a plurality of successive chambers that the first and second rotors and the casing together delimit.

Preferably, regardless of the respective angular positions of the first and second rotors, there are always two closed chambers among the successive chambers.

Preferably, one of the successive chambers is a collecting chamber which has the outlet from the internal volume.

Preferably, the threading of the first screw and the threading of the second screw delimit helical grooves, the downstream ends of these helical grooves being open and coming out into the collecting chamber regardless of the angular positions of the first and second rotors. When such is the case, the first and second screws do not carry out any compression. The heating of the gas because of its compression occurs essentially at the first and second lobe portions. For that reason, it is easier to prevent a big increase in the temperature of the first and second screws in operation and thus to prevent significant deformations in these first and second screws owing to expansions.

Preferably, one of the successive chambers is an intake chamber which communicates with the inlet.

Preferably, the first rotor is a male rotor, the second rotor being a female rotor.

Preferably, the second rotor comprises one more lobe than the first rotor.

Preferably, the first rotor comprises a plurality of lobes which number two, the second rotor comprising a plurality of lobes which number three.

Preferably, the first rotor has a cross section which is the same at the first lobe portion and at the first screw, apart from its angular orientation, while the second rotor has a cross section which is the same at the second lobe portion and at the second screw, apart from its angular orientation.

Preferably, the first rotor comprises at least two monobloc elements, kept together, which are a first monobloc element comprising at least the first screw and a second monobloc element comprising at least one part of the first lobe portion.

The invention also has as subject matter a set of a plurality of dry pumps for gases such as defined previously. The first screws of a first dry pump for gases of the set and of a second dry pump for gases of the set are identical, the second screws of the first dry pump for gases and of the second dry pump for gases being identical, the first and second lobe portions of the first dry pump for gases having an axial dimension which is a first axial dimension, the first and second lobe portions of the second dry pump for gases having an axial dimension which is a second axial dimension different from the first axial dimension.

BRIEF DESCRIPTION OF THE DRAWINGS

Other advantages and features will emerge more clearly from the description which follows of a particular embodiment of the invention, given by way of non-limiting example, and represented in the annexed drawings of which:

FIG. 4 is a view which is simplified like FIGS. 2 and 3, which represents the same rotors as FIG. 2, as well as chambers partially delimited by these rotors in the pump of FIG. 1, and where the rotors are seen from one end;

FIG. 5 is a view in perspective which is simplified like FIGS. 2 and 3 and which represents the same rotors as FIG. 2, as well as chambers partially delimited by these rotors in the pump of FIG. 1;

DESCRIPTION OF A PREFERRED EMBODIMENT OF THE INVENTION

Figure 1:
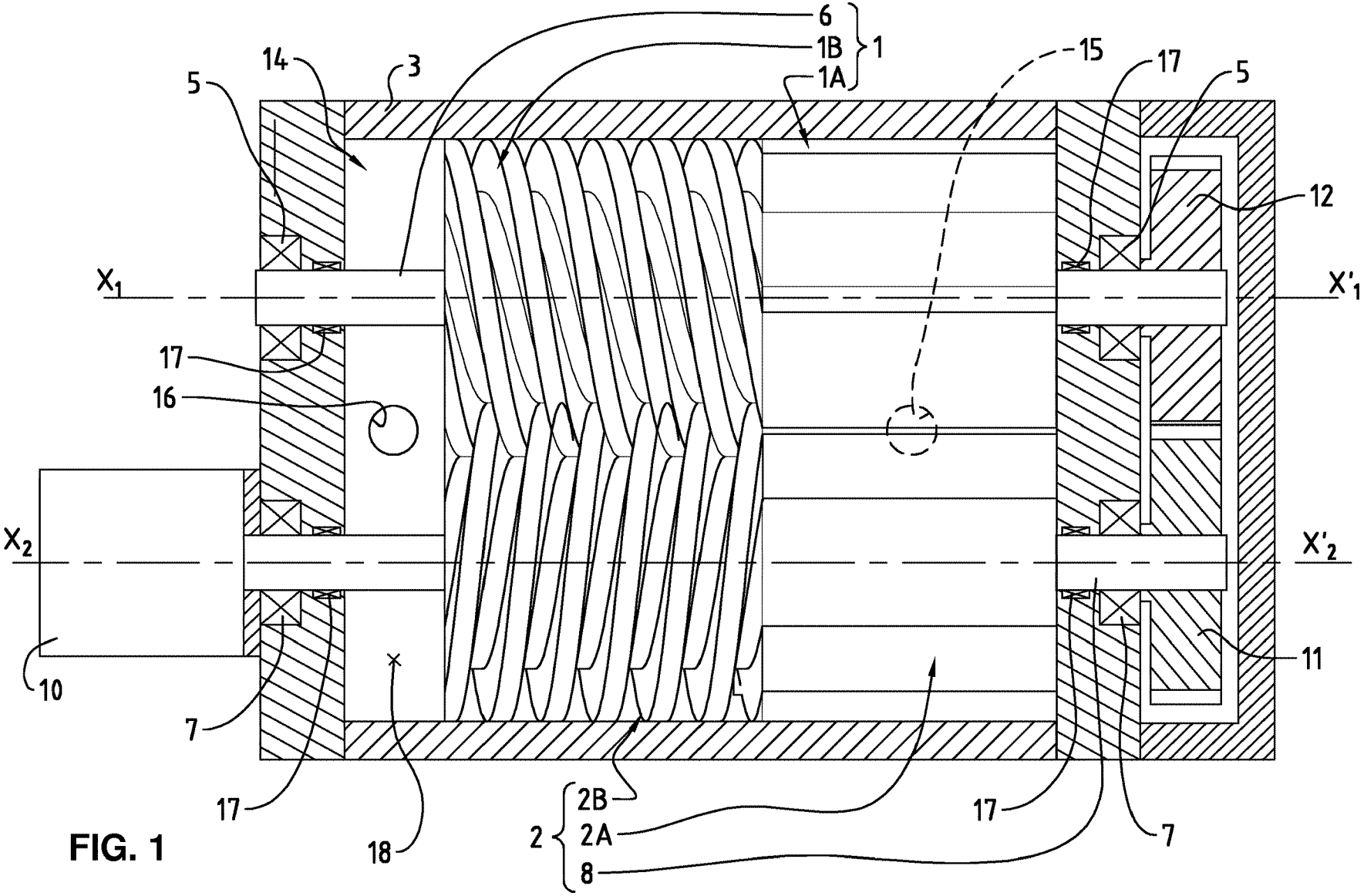
FIG. 1 is a schematic view and axial section of a dry pump for gases according to one embodiment of the invention.

In FIG. 1, a dry pump for gases according to one embodiment of the invention comprises a first rotor 1 and a second rotor 2, which are mounted in a casing 3 in several parts kept assembled.

A plurality of bearings 5 support a shaft 6 of the first rotor 1 in such a way that this first rotor 1 is rotational on an axis of rotation $X_1$-$X'_1$. A plurality of bearings 7 support a shaft 8 of the second rotor 2 in such a way that this second rotor 2 is rotational on an axis of rotation $X_2$-$X'_2$ parallel to the axis of rotation $X_1$-$X'_1$. In the sense intended here and in the annexed claims, the axial direction is the direction parallel to the axes of rotation $X_1$-$X'_1$, and $X_2$-$X'_2$, while an axial dimension is a dimension in the direction parallel to the axes of rotation $X_1$-$X'_1$, and $X_2$-$X'_2$.

One end of the shaft 8 is coupled to a motor 10 for driving the first and second rotors 1 and 2. Opposite the motor 10, the shaft 8 of the second rotor 2 bears a toothed wheel 11 which meshes with a toothed wheel 12 borne by the shaft 6 of the first rotor 1. The toothed wheels 11 and 12 form a gearing whose gear ratio equal to 3/2 is such that the first rotor 1 turns faster than the second rotor 2.

The first rotor 1 comprises a first lobe portion 1A and a first screw 1B which follow one another axially without distance between them. The second rotor 2 comprises a second lobe portion 2A and a second screw 2B which follow one another axially without distance between them. The first lobe portion 1A, the first screw 1B, the second lobe portion 2A and the second screw 2B are all in a same internal volume 14, which the casing 3 delimits without compartmentalizing it.

An inlet 15 for gas intake passes through the casing 3 and comes out into the internal volume 14, at the first and second lobe portions 2A and 2B, of one side of the plane passing through the axes of rotation $X_1$-$X'_1$ and $X_2$-$X'_2$. An outlet 16 for the discharge of gases passes through the casing 3 and communicates with the internal volume 14, at a collecting chamber 18, which is constituted by a downstream portion of this internal volume 14 and which is located at the outlet of the first and second screws 1B and 2B, that is to say opposite the first and second lobe portions 1A and 2A in relation to these first and second screws 1B and 2B.

The internal volume 14 is cylindrical at least at the first and second screws 1B and 2B, by being constituted by the union of two interpenetrating cylinders of revolution, the respective axes of which are the axes of rotation $X_1$-$X'_1$ and $X_2$-$X'_2$. At the first and second lobe portions 1A and 2A, the internal volume 14 is cylindrical in an identical way, at least on the side opposite the inlet 15 in relation to the plane containing the axes of rotation $X_1$-$X'_1$ and $X_2$-$X'_2$. At the inlet 15, a downstream and lateral portion of the internal volume 14 can constitute an intake chamber where the internal volume 14 is enlarged laterally and where the inlet 15 comes out.

The reference numerals 17 designate devices, each of which achieves a tightness between the casing 3 and one of the shafts 6 and 8.

Figure 2:
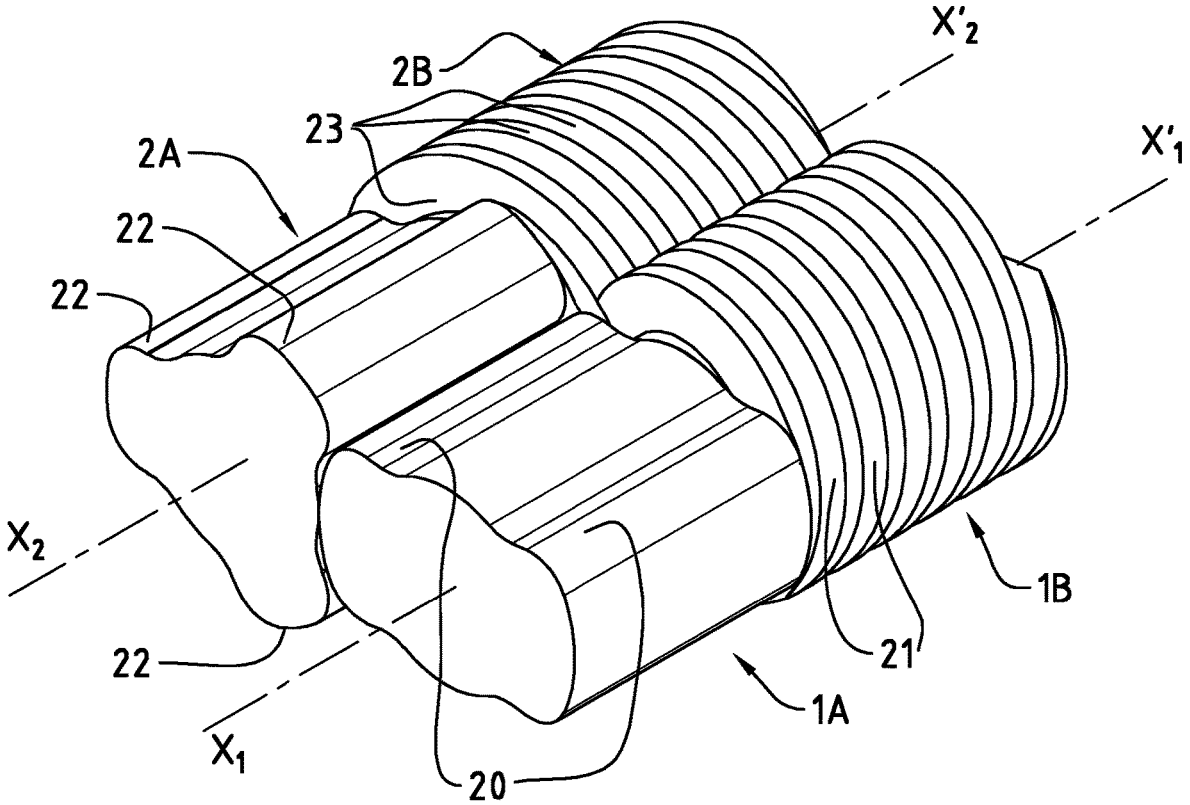
FIG. 2 is a view in perspective which represents two constituent rotors of the pump of FIG. 1 and which is simplified in that the shafts of these rotors are omitted.

As can be seen in FIG. 2, the first rotor 1 is a male rotor. The first lobe portion 1A comprises a plurality of lobes 20 which are identical and which number two in the embodiment represented. The screw 1B comprises a threading made up of as many helical threads 21 as there are lobes 20. This threading is invariable on the entire length of the screw 1B. Its pitch, its average diameter and its profile, that is to say the shape and the dimensions of its section along an axial plane passing through the axis of rotation $X_1$-$X'_1$, are invariable on the entire length of the screw 1B. Each lobe 20 is extended by one of the two helical threads 21, which are identical. The number of lobes 20 can be different from two. The same applies to the number of helical threads 21.

The second rotor 2 is a female rotor. The second lobe portion 2A comprises a plurality of lobes 22 which are identical and which number three in the embodiment represented. The screw 2B comprises a threading made up of as many helical threads 23 as there are lobes 22. This threading is invariable on the entire length of the screw 2B. Its pitch, its average diameter and its profile, that is to say the shape and the dimensions its section along an axial plane passing through the axis of rotation $X_2$-$X'_2$, are invariable on the entire length of the screw 2B. Each lobe 22 is extended by one of the three helical threads 23, which are identical. The number of lobes 22 can be different from two. The same applies to the number helical threads 23.

The first lobe portion 1A meshes with the second lobe portion 2A. The first and second screws 1B and 2B interlock.

The first rotor 1 has a cross section which is the same at the first lobe portion 1A and at the first screw 1B, apart from its angular orientation. In an identical way, the second rotor 2 has a cross section which is the same at the second lobe portion 2A and at the second screw 2B, apart from its angular orientation.

Figure 3:
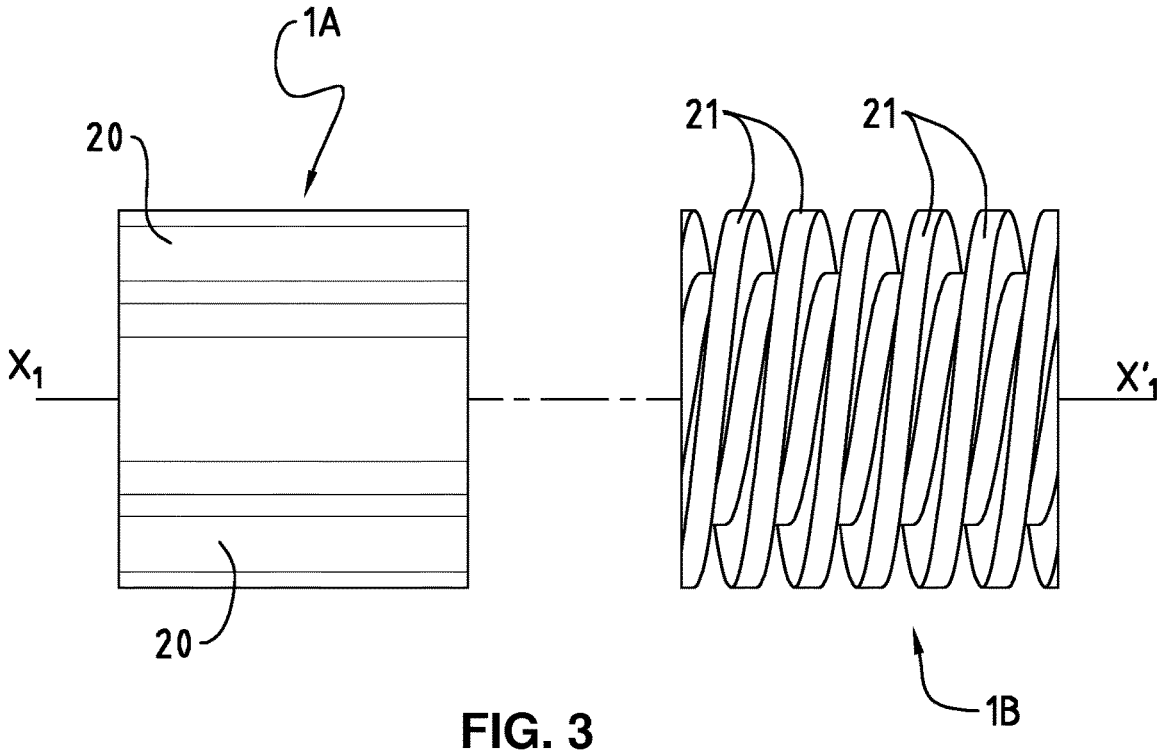
FIG. 3 is a lateral and exploded view, which represents a single one of the two rotors of the pump of FIG. 1 and which is simplified in that the shaft of the rotor represented is omitted.

As can be seen well in FIG. 3, the first rotor 1 results from the assembly of a plurality of monobloc elements, of which a first comprises the first lobe portion 1A and of which a second comprises the first screw 1B. The shaft 6 can be part of the first monobloc element of the first rotor 1 or of the second monobloc element of the first rotor 1. Likewise, a third monobloc element of the first rotor 1 can constitute the shaft 6. The second rotor 2 results from the assembly of a plurality of monobloc elements, of which a first comprises the second lobe portion 2A and of which a second comprises the second screw 2B. The shaft 8 can be part of either of the first and second monobloc elements of the second rotor 2. Likewise, a monobloc element distinct from the first and second monobloc elements of the second rotor 2 can constitute the shaft 8.

At all times, the first rotor 1, the second rotor 2 and the casing 3 delimit jointly a plurality of successive chambers which are visible in FIG. 4, for certain ones, and in FIG. 5, for all. Among these successive chambers are the collecting chamber 18, the intake chamber mentioned above and designated by reference numeral 25 in FIGS. 4 and 5, as well as the chambers 30, 31, 32 and 33.

Figure 7:
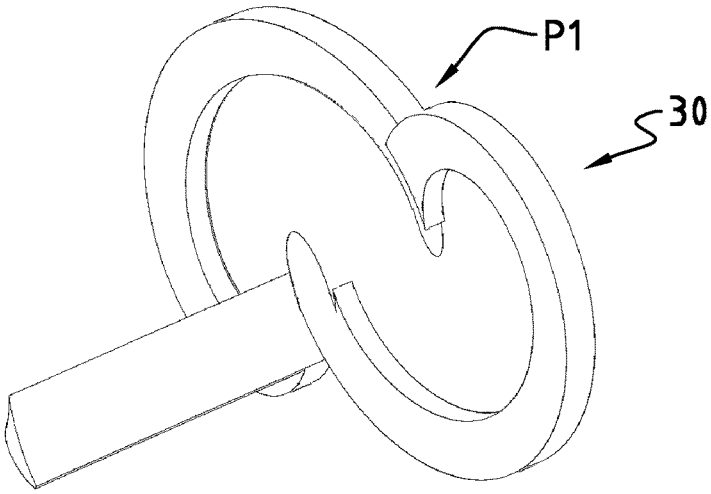
FIG. 7 is a view in perspective which represents the same chamber as FIG. 6 but later, that is to say at a moment after the moment at which this chamber is such as represented in FIG. 6.
Figure 8:
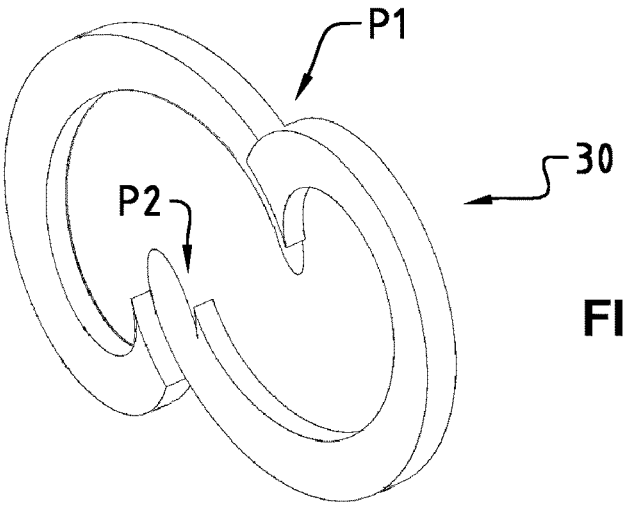
FIG. 8 is a view in perspective which represents the same chamber as FIGS. 6 and 7 but later, that is to say at a moment after that moment at which this chamber is such as represented in FIG. 7.

When the first and second rotors 1 and 2 are located in the configuration represented in FIGS. 4 and 5, the chambers 30, 31, 32 and 33 are closed. When the dry pump for gases of FIG. 1 operates, the first and second rotors 1 turn in opposite directions, as indicated by the arrows in FIG. 4. Therefore the chambers 30, 31, 32 and 33 evolve, which is illustrated by FIGS. 6 to 8, representing the single chamber 30 at successive moments.

Figure 6:
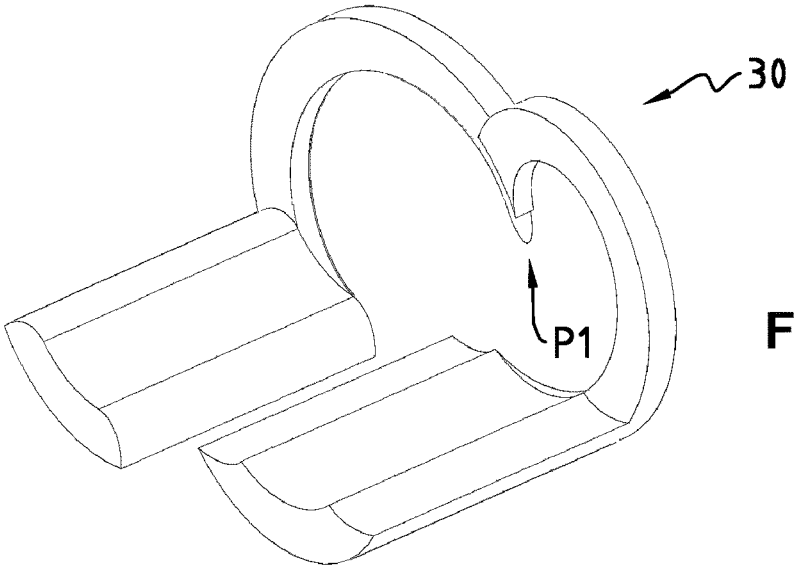
FIG. 6 is a view in perspective representing one chamber from among the chambers visible in FIGS. 4 and 5.

When the first and second rotors 1 and 2 are located in the configuration represented in FIGS. 4 and 5, the chamber 30 is as shown in FIG. 6. After the first rotor 1 and the second rotor 2 have turned respectively by half a turn and by a third of a turn starting from positions which they have in FIGS. 4 and 5, the chamber 30 is as shown in FIG. 7. When it is as shown in FIG. 7, the chamber 30 has the shape and the position which the chamber 31 has in FIGS. 4 and 5. After the first rotor 1 and the second rotor 2 have turned respectively by one turn and by ⅔ of a turn starting from the positions that they have in FIGS. 4 and 5, the chamber 30 is as shown in FIG. 8. When it is as shown in FIG. 8, the chamber 30 has the shape and the position which the chamber 32 has in FIGS. 4 and 5.

Described now will be the evolution of the chamber 30 in the course of time, while the first and second rotors turn continuously in opposite directions.

In FIG. 6, the chamber 30 is closed by being blocked, at its downstream end, that is to say at P1, by the intersection of a helical thread 21 and a helical thread 23. Still in FIG. 6, the first and second lobe portions 1A and 2A, a portion of the first screw 1B, a portion of the second screw 2B and the casing 3 together delimit the chamber 30, which has almost reached its maximum capacity.

The rotations of the first and second rotors 1 and 2 in opposite directions continue continuously starting from their positions in FIGS. 4 and 5. Therefore, the first and second lobe portions 1A and 2A arrive at a configuration starting from which they together reduce the capacity of the chamber 30 of which the downstream end is still blocked at P1 by the intersection of a helical thread 21 and a helical thread 23. In FIG. 7, the chamber 30 is represented at a selected moment while the first and second lobe portions 1A and 2A reduce together the capacity of the chamber 30. At the same time that the first and second lobe portions 1A and 2A reduce together the capacity of the chamber 30, a compression of the gas present in this chamber 30 occurs.

While the rotations of the first and second rotors 1 and 2 in opposite directions continue, the compression in the chamber 30 is followed by a blocking of the upstream end of this chamber 30, by the intersection of a helical thread 21 and a helical thread 23. After the blocking of its upstream end occurs, the chamber 30 is as shown in FIG. 8. The blocking of the upstream end of the chamber 30 is located at P2 in this FIG. 8.

Once the blocking at P2 occurs, the continuation of the rotations of the first and second rotors 1 and 2 in opposite directions causes the chamber 30 to be displaced in axial direction, downstream, but without changing capacity. In other words, there is no compression in the chamber 30 after the blocking at P2 has taken place.

When the chamber 30 reaches the downstream end of the first and second screws 1B and 2B, there is no compression there again in this chamber 30, since the outlet 16 is at a distance from the first and second screws 1B and 2B.

Figure 9:
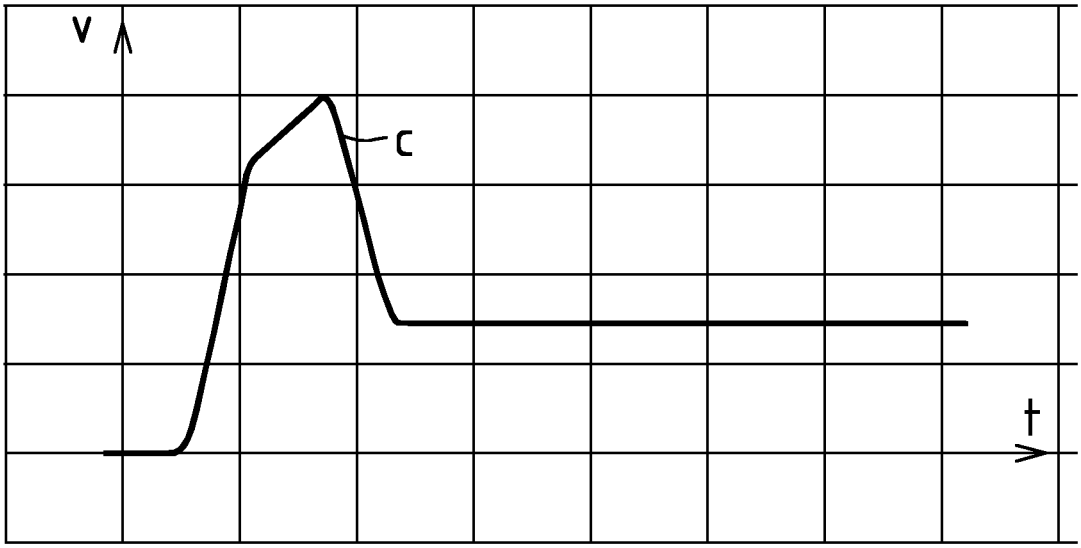
FIG. 9 is a graph which represents the evolution of the capacity of the chamber of FIGS. 6 to 8 in the course of time.

The curve C in FIG. 9 is the graphic representation of the capacity V of the chamber 30 as a function of time t.

It can be seen from the foregoing that the role of the first and second screws 1B and 2B is not to bring about a reduction of the capacity and thus a compression. The first and second screws have as their role to carry out a succession of identical blockages at the blocking point at P1, which retains gas when, in the chamber 30, this gas is compressed by the first and second lobe portions 1A and 2A. The first and second screws also have as a role to carry out a succession of identical blockages at the blocking point at P2, which isolates the gas present in the chamber 30 of the first and second lobe portions 1A and 2A after the compression of this gas.

As the compression has taken place essentially at the first and second lobe portions 1A and 2A, the heating up due to this compression occurs also essentially at the first and second lobe portions 1A and 2A. Thanks to this, a low temperature rise of the first and second screws 1B and 2B can be obtained, bringing about an efficient cooling of the internal volume 14 at the first and second lobe portions 1A and 2A. Moreover, a low temperature rise of the first and second screws 1B and 2B is advantageous insofar as it is rather complicated to master the consequences of expansions in screws owing to the fact that such screws have complex shapes.

The invention claimed is:

1. A dry pump for gases, comprising:

a first rotor comprising a first lobe portion and a first screw, a second rotor comprising a second lobe portion and a second screw, and a casing in which the first and second rotors are mounted and rotatable in such a way that the first and second screws mesh and the first and second lobe portions engage one with the other, wherein the first lobe portion comprises a plurality of first lobes, and the second lobe portion comprises a plurality of second lobes, there being more second lobes than first lobes, wherein the first rotor has a cross section which is the same at the first lobe portion and at the first screw, apart from its angular orientation, while the second rotor has a cross section which is the same at the second lobe portion and at the second screw, apart from its angular orientation, the casing delimiting an internal volume in which are located together the first and second screws and the first and second lobe portions, at least one inlet coming out into the internal volume at the first and second lobe portions, at least one outlet from the internal volume being located opposite the inlet relative to the first and second screws, each of the first and second screws comprising a threading invariable along its length, the first and second rotors being rotatable in opposite directions in such a way as to be able to be located successively in:

a first configuration in which the first and second lobe portions, a portion of the first screw, a portion of the second screw and the casing together delimit a chamber which is closed, a second configuration in which the chamber is always delimited by the first and second lobe portions, a portion of the first screw, a portion of the second screw and the casing in such a way as to be closed and have a smaller capacity than in the first configuration, a third configuration in which the chamber is displaced entirely at the first and second screws and isolated from the lobe portions at least by a helical thread of the threading of the first screw, a helical thread of the threading of the second screw and a blocking made by an intersection of the helical thread of the first screw and of the helical thread of the second screw, and a fourth configuration in which the chamber is displaced at a downstream end of the first and second screws and is in communication with the outlet.

2. The dry pump for gases according to claim 1, wherein the plurality of first and second lobes each extend by one of the helical threads of the threadings of the first and second screws.

3. The dry pump for gases according to claim 2, wherein a number of lobes of the first lobe portion is equal to a number of helical threads of the threading of the first screw, a number of lobes of the second lobe portion being equal to a number of helical threads of the threading of the second screw.

4. The dry pump for gases according to claim 1, wherein the outlet is located at a distance from the first and second screws.

5. The dry pump for gases according to claim 1, wherein the chamber is one of a plurality of successive chambers that the first and second rotors and the casing together delimit.

6. The dry pump for gases according to claim 5, wherein regardless of respective angular positions of the first and second rotors, there are always two closed chambers among the successive chambers.

7. The dry pump for gases according to claim 5, wherein one of the successive chambers is a collecting chamber which has the outlet from the internal volume.

8. The dry pump for gases according to claim 7, wherein the threading of the first screw and the threading of the second screw delimit helical grooves, downstream ends of these helical grooves being open and coming out into the collecting chamber regardless of respective angular positions of the first and second rotors.

9. The dry pump for gases according to claim 1, wherein the first rotor is a male rotor, the second rotor being a female rotor.

10. The dry pump for gases according to claim 1, wherein the second rotor comprises one more lobe than the first rotor.

11. The dry pump for gases according to claim 1, wherein the first rotor comprises two lobes, and the second rotor comprises three lobes.

12. The dry pump for gases according to claim 1, wherein the first rotor comprises at least two monobloc elements, kept together, which are a first monobloc element comprising at least the first screw and a second monobloc element comprising at least one part of the first lobe portion.

13. A set of a plurality of dry pumps for gases according to claim 1, wherein the first screws of a first dry pump for gases of the set and of a second dry pump for gases of the set are identical, the second screws of the first dry pump for gases and of the second dry pump for gases being identical.

14. The dry pump for gases according to claim 1, wherein each said first lobe extends radially outwards from a center of rotation of the first lobe portion to a distal end, and wherein a maximum radial distance between the center of rotation and each said distal end is the same.

15. The dry pump for gases according to claim 14, wherein said plurality of first lobes are all identical.

16. The dry pump for gases according to claim 14, wherein a profile of said first lobe portion has a cross-section and angular orientation that remains constant along an entire length thereof.

* * * * *